US008909112B2

(12) United States Patent
Takahashi et al.

(10) Patent No.: US 8,909,112 B2
(45) Date of Patent: Dec. 9, 2014

(54) IMAGE FORMING APPARATUS HAVING SUPPORT MEMBERS WITH PREDETERMINED ELECTRIC POTENTIALS

(75) Inventors: Tomoko Takahashi, Yokohama (JP); Naoyuki Ozaki, Zama (JP); Ryuji Yoshida, Yokohama (JP); Nobuyuki Koinuma, Yokohama (JP); Hiroaki Maeda, Ebina (JP); Shunichi Hashimoto, Yokohama (JP); Mugijirou Uno, Isehara (JP); Yoshinori Nakagawa, Yokohama (JP); Mikio Ishibashi, Yokohama (JP); Hideki Zemba, Kawasaki (JP)

(73) Assignee: Ricoh Company, Limited, Tokyo (JP)

( * ) Notice: Subject to any disclaimer, the term of this patent is extended or adjusted under 35 U.S.C. 154(b) by 498 days.

(21) Appl. No.: 12/879,585

(22) Filed: Sep. 10, 2010

(65) Prior Publication Data

US 2011/0064488 A1 Mar. 17, 2011

(30) Foreign Application Priority Data

Sep. 14, 2009 (JP) ..... 2009-212227

(51) Int. Cl.
*G03G 15/01* (2006.01)
*G03G 15/20* (2006.01)
*G03G 15/16* (2006.01)

(52) U.S. Cl.
CPC ..... *G03G 15/0131* (2013.01); *G03G 15/161* (2013.01); *G03G 15/1605* (2013.01)
USPC ..... 399/317; 399/302; 399/303; 399/308

(58) Field of Classification Search
USPC ..... 399/49, 72, 301–303, 308, 317, 394
See application file for complete search history.

(56) References Cited

U.S. PATENT DOCUMENTS 6,223,008 B1 * 4/2001 Takahashi et al. ..... 399/66
6,600,894 B2 * 7/2003 Takahashi et al. ..... 399/303

(Continued)

FOREIGN PATENT DOCUMENTS

JP 10-55094 2/1998
JP 2001-125456 5/2001

(Continued)

OTHER PUBLICATIONS

U.S. Appl. No. 12/708,901, filed Feb. 19, 2010, Jun Kosako, et al.

(Continued)

*Primary Examiner* — Joseph S Wong
(74) *Attorney, Agent, or Firm* — Oblon, Spivak, McClelland, Maier & Neustadt, L.L.P.

(57) ABSTRACT

An image forming apparatus including a conveyance unit to convey a transfer medium, a first image forming unit to form a monochrome image transferred at a first transfer position onto the transfer medium, and a second image forming unit disposed downstream from the first image forming unit in a direction of conveyance of the transfer medium, including an intermediate transfer body to form a multi-colored toner image on the intermediate transfer body. The multi-colored toner image is transferred onto the transfer medium at a second transfer position. The conveyance unit is separated from the intermediate transfer body at the second transfer position in a monochrome mode to form the monochrome image using only the first image forming unit, and contacts the intermediate transfer body at the second transfer position in a full-color mode to form a full-color image using both the first and second image forming units.

8 Claims, 4 Drawing Sheets

(56) References Cited

U.S. PATENT DOCUMENTS

| | | | | |
|---|---|---|---|---|
| 6,853,829 | B2 * | 2/2005 | Hoshi et al. | 399/299 |
| 6,947,682 | B2 | 9/2005 | Kosugi et al. | |
| 7,155,152 | B2 | 12/2006 | Iwai et al. | |
| 7,463,855 | B2 * | 12/2008 | Shimmura | 399/298 |
| 7,672,605 | B2 | 3/2010 | Kayahara et al. | |
| 2008/0247780 | A1 * | 10/2008 | Hara | 399/162 |
| 2009/0123168 | A1 * | 5/2009 | Aoki et al. | 399/66 |
| 2009/0279906 | A1 | 11/2009 | Kuma et al. | |
| 2010/0040393 | A1 | 2/2010 | Kawahara et al. | |
| 2010/0061752 | A1 * | 3/2010 | Sudo et al. | 399/66 |
| 2010/0214364 | A1 | 8/2010 | Hirota et al. | |

FOREIGN PATENT DOCUMENTS

| | | |
|---|---|---|
| JP | 2002-182447 | 6/2002 |
| JP | 2005-91612 | 4/2005 |
| JP | 2006-85138 | 3/2006 |
| JP | 2006-251535 | 9/2006 |
| JP | 2009-198899 | 9/2009 |

OTHER PUBLICATIONS

U.S. Appl. No. 12/828,612, filed Jul. 1, 2010, Masaharu Furuya, et al.
Office Action issued Apr. 30, 2013 in Japanese Patent Application No. 2009-212227.

* cited by examiner

IMAGE FORMING APPARATUS HAVING SUPPORT MEMBERS WITH PREDETERMINED ELECTRIC POTENTIALS

CROSS-REFERENCE TO RELATED APPLICATIONS

The present patent application is based on and claims priority pursuant to 35 U.S.C. §119 from Japanese Patent Application No. 2009-212227, filed on Sep. 14, 2009 in the Japan Patent Office, which is incorporated herein by reference in its entirety. The present patent application is further related to U.S. patent application Ser. No. 12/434,009, filed on May 1, 2009, Ser. No. 12/542,289, filed on Aug. 17, 2009, Ser. No. 12/557,997, filed on Sep. 11, 2009, and Ser. No. 12/708,901, filed on Feb. 19, 2010, all in the United States Patent and Trademark Office, each of which is hereby incorporated herein by reference in its entirety.

BACKGROUND OF THE INVENTION

1. Field of the Invention

Exemplary aspects of the present invention generally relate to an image forming apparatus such as a copier, a printer, a plotter, a facsimile machine, or a multifunction device having two or more of copying, printing, plotting, and facsimile functions, and more particularly to a full-color image forming apparatus having both color and monochrome image forming units and a configuration capable of driving just the monochrome image forming unit provided therein to form a monochrome image.

2. Description of the Background

Related-art image forming apparatuses, such as copiers, printers, plotters, facsimile machines, and multifunction devices having two or more of copying, printing, plotting, and facsimile functions, typically form a toner image on a recording medium (e.g., a sheet of paper, etc.) according to image data using an electrophotographic method. In such a method, for example, a charger charges a surface of an image carrier (e.g., a photoconductor); an irradiating device emits a light beam onto the charged surface of the photoconductor to form an electrostatic latent image on the photoconductor according to the image data; a developing device develops the electrostatic latent image with a developer (e.g., toner) to form a toner image on the photoconductor; a transfer device transfers the toner image formed on the photoconductor onto a sheet of recording media; and a fixing device applies heat and pressure to the sheet bearing the toner image to fix the toner image onto the sheet. The sheet bearing the fixed toner image is then discharged from the image forming apparatus.

Full-color image forming apparatuses that form both monochrome and full-color images widely employ a tandem system. In the tandem system, multiple image forming parts each forming a toner image of a specific color are arranged side by side relative to a transfer medium. The toner images of the specific color respectively formed by the multiple image forming parts are sequentially transferred onto the transfer medium to form a full-color toner image on the transfer medium.

The tandem system may use either a direct transfer system, in which the toner images are directly transferred onto the last transfer medium such as a sheet of paper to form a full-color image on the sheet, or an indirect transfer system, in which the toner images are primarily transferred onto an intermediate transfer body to form a full-color toner image on the intermediate transfer body, and then the full-color toner image is secondarily transferred onto the sheet, that is, the last transfer medium, from the intermediate transfer body to form a full-color image on the sheet. The indirect transfer system can handle various types of recording media and reliably provide higher-quality images compared to the direct transfer system. Accordingly, the indirect transfer system has become more common in recent years.

However, in the above-described full-color image forming apparatuses, the intermediate transfer body, a cleaning member that cleans the intermediate transfer body, and so forth, must be operated in a monochrome mode to form a monochrome image in the same manner as in a full-color mode. Further, even in the monochrome mode, a period of time equal to that taken in the full-color mode for forming a full-color image is required. There are structural reasons for these outcomes, as described below.

The related-art image forming apparatuses include a first image forming unit that forms only a monochrome toner image on a recording medium and a second image forming unit that forms multi-colored toner image on a recording medium, in order to be able to handle formation of both monochrome and full-color images. In the monochrome mode, the second image forming unit is retracted so that only the first image forming unit is operated to form a monochrome image. Alternatively, the first image forming unit may be separately provided from the second image forming unit. However, movement of the second image forming unit degrades positional accuracy of rollers used in the full-color mode to form a full-color image.

In another approach, a conveyance path of the recording medium for the monochrome mode is separated from that for the full-color mode. However, this approach, although effective for the intended purpose, results in a complex and therefore costly configuration.

In yet another approach, a conveyance belt that conveys a recording medium having a monochrome toner image thereon to an intermediate transfer belt on which a multi-colored toner image is formed is movably provided to contact to or separate from the intermediate transfer belt. However, such movement of the conveyance belt may change an angle of entrance of the recording medium into the fixing device to which the recording medium is ultimately conveyed by the conveyance belt, causing image deterioration and possibly wrinkling the recording medium. In order to reduce mechanical movement of the conveyance belt, a gap formed between the conveyance belt and the intermediate transfer belt upon separation of the conveyance belt from the intermediate transfer belt is required to be smaller. However, the smaller gap between the conveyance belt and the intermediate transfer belt may cause the monochrome toner image formed on the recording medium to adversely contact a surface of the intermediate transfer belt while the recording medium is passing through the gap, or may cause toner of the monochrome toner image formed on the recording medium to scatter toward the intermediate transfer belt even when the monochrome toner image does not contact the intermediate transfer belt.

SUMMARY

In view of the foregoing, illustrative embodiments of the present invention provide a novel full-color image forming apparatus using a simple configuration to achieve higher accuracy in positioning toner images of each color to form a higher-quality full-color image. At the same time, the full-color image forming apparatus prevents deterioration of a monochrome toner image at a gap formed between an intermediate transfer body and a conveyance unit that conveys a recording medium having the monochrome toner image thereon to provide a higher-quality monochrome image. Further, the full-color image forming apparatus of the present disclosure solves problems caused by a change in an angle of entrance of the recording medium into a fixing device during different image forming modes, that is, a monochrome mode and a full-color mode.

In one illustrative embodiment, an image forming apparatus includes a conveyance unit to convey a transfer medium, a first image forming unit to form a monochrome image transferred at a first transfer position onto the transfer medium conveyed on the conveyance unit, and a second image forming unit disposed downstream from the first image forming unit in a direction of conveyance of the transfer medium, including an intermediate transfer body to form a multi-colored toner image on the intermediate transfer body. The multi-colored toner image is transferred from the intermediate transfer body onto the transfer medium conveyed on the conveyance unit at a second transfer position different from the first transfer position. The conveyance unit is separated from the intermediate transfer body at the second transfer position in a monochrome mode to form the monochrome image on the transfer medium using only the first image forming unit. The conveyance unit contacts the intermediate transfer body at the second transfer position in a full-color mode to form a full-color image on the transfer medium using both the first and second image forming units. The conveyance unit and the intermediate transfer body separated from each other at the second transfer position in the monochrome mode respectively have predetermined electric potentials at the second transfer position.

Another illustrative embodiment provides an image forming apparatus including a conveyance unit to convey a transfer medium, a first image forming unit to form a monochrome image transferred at a first transfer position onto the transfer medium conveyed on the conveyance unit, and a second image forming unit disposed downstream from the first image forming unit in a direction of conveyance of the transfer medium, including an intermediate transfer body to form a multi-colored toner image on the intermediate transfer body. The multi-colored toner image is transferred from the intermediate transfer body onto the transfer medium conveyed on the conveyance unit at a second transfer position different from the first transfer position. The conveyance unit is separated from the intermediate transfer body at the second transfer position in a monochrome mode to form the monochrome image on the transfer medium using only the first image forming unit. The conveyance unit contacts the intermediate transfer body at the second transfer position in a full-color mode to form a full-color image on the transfer medium using both the first and second image forming units. An electric field generated at the second transfer position in the monochrome mode is such that it does not cause scattering of toner of the monochrome image formed by the first image forming unit upon conveyance of the monochrome image through the second transfer position.

Additional features and advantages of the present disclosure will be more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
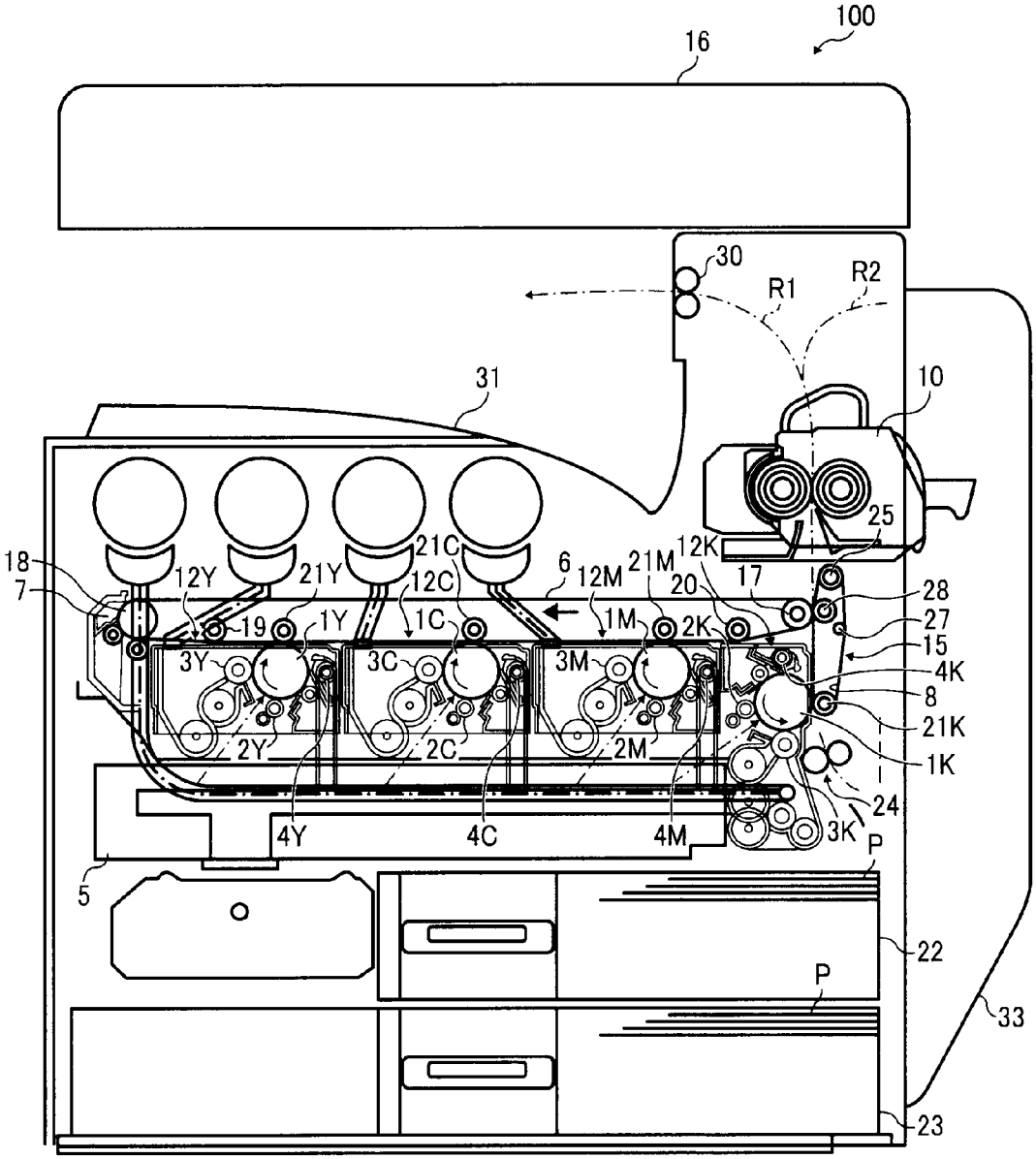
FIG. 1 is a schematic view illustrating a configuration of an image forming apparatus according to illustrative embodiments.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings.

In a later-described comparative example, illustrative embodiment, and exemplary variation, for the sake of simplicity the same reference numerals will be given to identical constituent elements such as parts and materials having the same functions, and redundant descriptions thereof omitted unless otherwise required.

A description is now given of a configuration and operations of a tandem type full-color digital copier serving as an image forming apparatus 100 according to illustrative embodiments. The image forming apparatus 100 uses toner of four different colors, that is, yellow (Y), cyan (C), magenta (M), and black (K).

FIG. 1 is a schematic view illustrating a configuration of the image forming apparatus 100 according to illustrative embodiments. The image forming apparatus 100 includes image forming parts 12Y, 12C, and 12M, each forming a toner image of yellow (Y), cyan (C), or magenta (M), serially arranged parallel to one another along an intermediate transfer belt 6 in that order, from upstream to downstream, relative to a direction of rotation of the intermediate transfer belt 6. The intermediate transfer belt 6 has a horizontally extended loop shape, and serves as an intermediate transfer body. The image forming parts 12Y, 12C, and 12M and the intermediate transfer belt 6 together function as a second image forming unit to form a multi-colored toner image, to be distinguished from a first image forming unit, constituted by an image forming part 12K to form a monochrome image, which is separately provided from the second image forming unit.

Specifically, the first image forming unit is provided upstream from the second image forming unit in a direction of conveyance of a recording medium such as a sheet P. The image forming part 12K is arranged such that a black toner image formed on a surface of a photoconductor 1K provided therein is directly transferred onto the sheet P. The image forming part 12K is separately provided from the image forming parts 12Y, 12C, and 12M as described above, and the black toner image formed by the image forming part 12K is directly transferred onto the sheet P by a conveyance unit 15 without being primarily transferred onto the intermediate transfer belt 6 first.

The conveyance unit 15 is provided substantially perpendicular to the intermediate transfer belt 6. Specifically, the image forming part 12K is provided along a substantially vertical conveyance path of the sheet P, and the conveyance unit 15 is provided upstream from a fixing device 10 in the direction of conveyance of the sheet P.

Each of the image forming parts 12Y, 12C, 12M, and 12K (hereinafter also collectively referred to as image forming parts 12) is constituted as a process cartridge detachably attachable to the image forming apparatus 100.

The image forming parts 12 include photoconductors 1Y, 10, 1M, and 1K (hereinafter collectively referred to as photoconductors 1) each serving as an image carrier; chargers 2Y, 2C, 2M, and 2K (hereinafter collectively referred to as chargers 2); developing devices 3Y, 3C, 3M, and 3K (hereinafter collectively referred to as developing devices 3) that supply toner of the respective colors to electrostatic latent images formed on the photoconductors 1 to form toner images of the respective colors; cleaning devices 4Y, 4C, 4M, and 4K (hereinafter collectively referred to as cleaning devices 4); and so forth, respectively. Although the cleaning devices 4 include a blade to remove residual toner from the surfaces of the photoconductors 1, respectively, the configuration of the cleaning devices 4 is not limited thereto. Alternatively, for example, the cleaning devices 4 may include a fur brush roller or a magnetic brush in place of the blade. The image forming parts 12Y, 12C, and 12M are provided such that the photoconductors 1Y, 10, and 1M contact a lower extended surface of the intermediate transfer belt 6.

An irradiating device 5 is provided below the image forming parts 12Y, 12C, and 12M, and forms the electrostatic latent images of the respective colors on surfaces of the photoconductors 1 with laser beams. Further, although employing a laser system, alternatively, the irradiating device 5 may employ an LED system or the like.

A description is now given of formation of full-color images.

Full-color image data of a document read by a scanner 16, received by a facsimile machine, or sent from a computer is separated into each color of yellow, cyan, magenta, and black to form data of each color. The data of each color thus formed is then sent to the irradiating device 5. Based on the data of each color, the irradiating device 5 directs laser beams onto the surfaces of the photoconductors 1 evenly charged by the chargers 2 to form electrostatic latent images of the respective colors on the surfaces of the photoconductors 1. The developing devices 3 develop the electrostatic latent images thus formed with toner of the respective colors so that toner images are formed on the surfaces of the photoconductors 1, respectively. The toner images formed on the surfaces of the photoconductors 1Y, 1C, and 1M are primarily transferred onto the intermediate transfer belt 6 by primary transfer rollers 21Y, 21C, and 21M, each serving as a primary transfer unit, at primary transfer positions and superimposed one atop the other to form a multi-colored toner image on the intermediate transfer belt 6.

The intermediate transfer belt 6 is wound around multiple transfer support members including a drive roller 17 serving as a first support member, a driven roller 18, and tension rollers 19 and 20. The primary transfer rollers 21Y, 21C, and 21M are provided opposite the photoconductors 1Y, 10, and 1M, respectively, with the intermediate transfer belt 6 interposed therebetween. A belt cleaning device 7 that removes residual toner from the surface of the intermediate transfer belt 6 is provided opposite the driven roller 18 outside the intermediate transfer belt 6.

Meanwhile, the black toner image formed on the surface of the photoconductor 1K is directly transferred onto the sheet P conveyed by a conveyance belt 8 included in the conveyance unit 15. Thereafter, the sheet P having the black toner image thereon is further conveyed by the conveyance belt 8 to the intermediate transfer belt 6 so that the multi-colored toner image formed on the intermediate transfer belt 6 is transferred onto the sheet P. Accordingly, the conveyance belt 8 serves both as a direct transfer belt at a direct transfer position to directly transfer the black toner image from the surface of the photoconductor 1K onto the sheet P (hereinafter referred to as a first transfer position), and as a secondary transfer belt at a secondary transfer position to secondarily transfer the multi-colored toner image from the intermediate transfer belt 6 onto the sheet P (hereinafter referred to as a second transfer position).

Sheet feed trays 22 and 23 each storing the sheets P are provided at the bottom of the image forming apparatus 100. The sheet P fed from one of the sheet feed trays 22 and 23 by a sheet feed unit, not shown, is conveyed to a pair of registration rollers 24 by a conveyance part, not shown. After skew of the sheet P is corrected by the pair of registration rollers 24, the sheet P is conveyed to the first transfer position between the photoconductor 1K and the conveyance belt 8 at a predetermined timing by the pair of registration rollers 24 so that the black toner image is directly transferred onto the sheet P from the surface of the photoconductor 1K. Thereafter, the sheet P having the black toner image thereon is conveyed to the second transfer position by the conveyance belt 8, and the multi-colored toner image is secondarily transferred onto the sheet P from the intermediate transfer belt 6 and is superimposed on the black toner image so that a full-color toner image is formed on the sheet P.

The sheet P having the full-color toner image thereon is then further conveyed to the fixing device 10 by the conveyance belt 8 to fix the full-color toner image on the sheet P. Thereafter, the sheet P having the fixed full-color image thereon is conveyed to a pair of discharging rollers 30 through a conveyance path R1 and is discharged to a discharge tray 31 by the pair of discharging rollers 30 with a side of the sheet P having the full-color image thereon facing down. By contrast, during duplex printing, the sheet P is redirected to a conveyance path R2 by a switching pick, not shown, after the full-color toner image is fixed onto the sheet P by the fixing device 10. Thereafter, the sheet P is reversed by a duplex unit 33 and is conveyed again to the pair of the registration rollers 24. The rest of the processes are the same as those in simplex printing described above.

The conveyance unit 15 includes the conveyance belt 8 and multiple conveyance support members that support the conveyance belt 8, including a drive roller 25 serving as a third support member, a driven roller 21K serving both as a fourth support member and a direct transfer unit to directly transfer the black toner image from the surface of the photoconductor 1K onto the sheet P, a tension roller 27, and a secondary transfer roller 28 serving both as a second support member and a secondary transfer unit to secondarily transfer the multi-colored toner image from the intermediate transfer belt 6 onto the sheet P.

The secondary transfer roller 28 is provided opposite the drive roller 17 around which the intermediate transfer belt 6 is wound, and is caused to contact to and separate from the intermediate transfer belt 6 with the conveyance belt 8 interposed therebetween by a contact/separation mechanism, not shown. Accordingly, the multi-colored toner image can be secondarily transferred from the intermediate transfer belt 6 onto the sheet P conveyed by the conveyance belt 8 by merely moving the secondary transfer roller 28, thereby simplifying the configuration.

A description is now given of formation of monochrome images, with an image forming apparatus having the structure described above.

In a monochrome mode to form a monochrome image, first, an electrostatic latent image of black is formed on the surface of the photoconductor 1K by the irradiating device 5 with a laser beam based on image data for the color of black. The developing device 3K develops the electrostatic latent image thus formed with black toner so that a black toner image is formed on the surface of the photoconductor 1K. The black toner image is then directly transferred by the driven roller 21K from the surface of the photoconductor 1K onto the sheet P conveyed by the conveyance belt 8. Thereafter, the sheet P having the black toner image thereon is further conveyed by the conveyance belt 8 to the fixing device 10 so that the black toner image is fixed to the sheet P by the fixing device 10. The sheet P having the fixed image of black thereon is then discharged to the discharge tray 31 by the pair of discharging rollers 30.

Specifically, in the monochrome mode, the conveyance belt 8 is separated from the intermediate transfer belt 6 by the contact/separation mechanism where the intermediate transfer belt 6 and the conveyance belt 8 contact each other to form a full-color image in a full-color mode, that is, the second transfer position, to form a gap therebetween. Further, the image forming units 12Y, 12C, and 12M and the intermediate transfer belt 6 are not driven in the monochrome mode, thereby extending the product life of those components. Because the intermediate transfer belt 6 is not moved, the position of the intermediate transfer belt 6 is unchanged while the conveyance belt 8 is moved to separate from the intermediate transfer belt 6. An advantage of this arrangement is that the tension of the intermediate transfer belt 6 can be kept constant.

One possible alternative configuration is to movably provide the intermediate transfer belt 6 to contact to and separate from the conveyance belt 8 which is fixed instead. However, this configuration may degrade accuracy in the primary transfer positions of the toner images of yellow, cyan, and magenta over time. Therefore, in the image forming apparatus 100 according to illustrative embodiments described herein, the position of the intermediate transfer belt 6 is not changed, so that the intermediate transfer belt 6 remains in contact with the surfaces of the photoconductors 1Y, 10, and 1M. As a result, higher positional accuracy in the drive roller 17, the driven roller 18, and the tension rollers 19 and 20 around which the intermediate transfer belt 6 is wound can be also achieved, thereby preventing wrinkles in the intermediate transfer belt 6. Further, stable rotation of the intermediate transfer belt 6 can be achieved, thereby preventing color shift in the full-color image formed in the full-color mode.

Figure 2A:
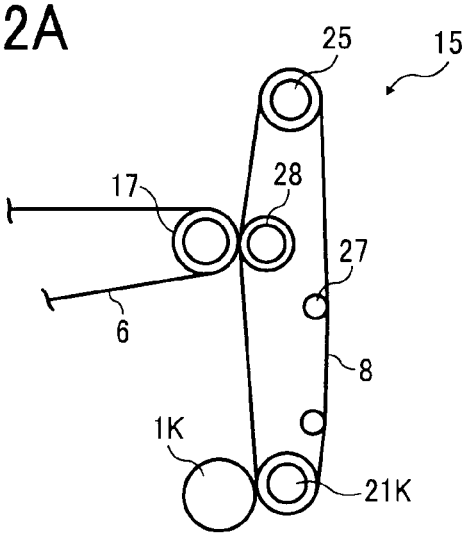
FIGS. 2A and 2B are schematic views respectively illustrating operations to contact or separate a conveyance unit to or from an intermediate transfer body according to a first illustrative embodiment.
Figure 2B:
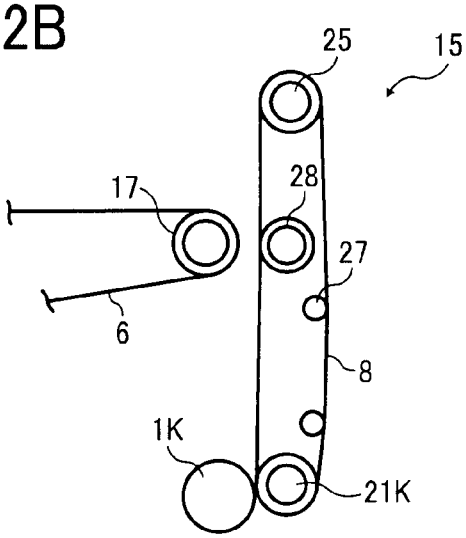

FIGS. 2A and 2B are schematic views respectively illustrating an example of a configuration around the second transfer position between the intermediate transfer belt 6 and the conveyance belt 8 according to a first illustrative embodiment. Specifically, FIG. 2A illustrates a state in which the intermediate transfer belt 6 and the conveyance belt 8 contact each other. The sheet P having the black toner image thereon is attracted to the conveyance belt 8 and is conveyed to contact the intermediate transfer belt 6 at the second transfer position. As a result, the multi-colored toner image formed on the intermediate transfer belt 6 is transferred onto the sheet P and is superimposed on the black toner image so that a full-color toner image is formed on the sheet P. The sheet P having the full-color toner image thereon is separated from the conveyance belt 8 at a portion where the conveyance belt 8 is wound around the drive roller 25 and is further conveyed to the fixing device 10.

FIG. 2B illustrates a state in which the conveyance belt 8 is separated from the intermediate transfer belt 6 in the monochrome mode, forming a gap therebetween. The sheet P having the black toner image thereon is attracted to the conveyance belt 8 and is conveyed to merely pass through the gap between the intermediate transfer belt 6 and the conveyance belt 8. Thereafter, the sheet P having the black toner image thereon is separated from the conveyance belt 8 at the portion where the conveyance belt 8 is wound around the drive roller 25 and is further conveyed to the fixing device 10.

If a curvature at a portion where the intermediate transfer belt 6 is wound around the drive roller 17 to contact the sheet P is larger when the intermediate transfer belt 6 and the conveyance belt 8 contact each other as illustrated in FIG. 2A, the sheet P is separated from the conveyance belt 8 at that portion, preventing stable conveyance of the sheet P to the fixing device 10. To solve the above-described problem, in the image forming apparatus 100, the sheet P is separated from the conveyance belt 8 at the single position, that is, the portion where the conveyance belt 8 is wound around the drive roller 25, regardless of whether the intermediate transfer belt 6 and the conveyance belt 8 contact or do not contact each other. As a result, the sheet P is reliably conveyed to the fixing device 10 from the conveyance unit 15, thereby preventing problems such as wrinkling the sheet P in the fixing device 10.

The secondary transfer roller 28 is movably provided as described above while the positions of each of the drive roller 25, the driven roller 21K, and the drive roller 17 remain fixed, so that the conveyance belt 8 is caused to contact to and separate from the intermediate transfer belt 6. The tension roller 27 is moved by a force from a biasing unit, not shown, along with movement of the secondary transfer roller 28 to maintain the tension of the conveyance belt 8.

The position of each of the drive roller 25, the driven roller 21K, and the drive roller 17 is fixed as described above so that the sheet P attracted to the conveyance belt 8 is separated from the conveyance belt 8 at the position where the conveyance belt 8 is wound around the drive roller 25 regardless of the monochrome mode or the full-color mode. Accordingly, a path and an angle of the sheet P entering the fixing device 10 are not changed upon switching of the modes. As a result, sheet jam and wrinkling of the sheet P in the fixing device 10 can be prevented, thereby reliably fixing the toner image on the sheet P. Further, because the intermediate transfer belt 6 itself is not moved during contact and separation of the intermediate transfer belt 6 and the conveyance belt 8, high positional accuracy in the primary transfer rollers 21Y, 21C, and 21M can be achieved, thereby preventing color shift in the full-color image.

While the conveyance belt 8 is separated from the intermediate transfer belt 6 as illustrated in FIG. 2B, the secondary transfer roller 28 remains in contact with the conveyance belt 8 to prevent the conveyance belt 8 from fluttering, thereby providing stable rotation of the conveyance belt 8 at the gap between the intermediate transfer belt 6 and the conveyance belt 8 even in the monochrome mode. In other words, the gap formed between the intermediate transfer belt 6 and the conveyance belt 8 is reliably kept constant in the monochrome mode, so that toner scattering from the black toner image due to vibration of the conveyance belt 8 can be prevented.

A description is now given of an electric field generated at the gap formed between the intermediate transfer belt 6 and the conveyance belt 8 upon conveyance of the sheet P having the black toner image thereon through the gap, since such fields can scatter the toner of the black toner image.

An electric discharge occurs at the first transfer position upon direct transfer of the black toner image from the photoconductor 1K onto the sheet P, with both the surface of the sheet P having the black toner image thereon and a back surface of the conveyance belt 8 charged. The sheet P and the conveyance belt 8 thus charged change an electric potential at the gap when the sheet P enters in the gap, possibly generating an electric field in a direction to scatter toner of the black toner image on the sheet P onto the intermediate transfer belt 6. The toner of the black toner image scatters when a force from the electric field exceeds a force that attracts the toner to the sheet P.

Figure 3:
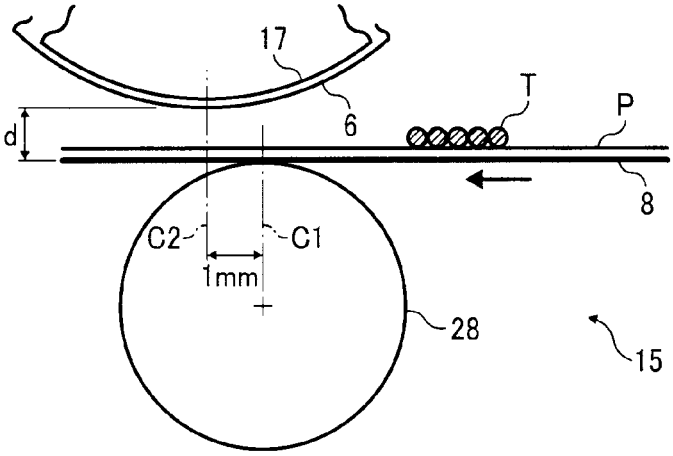
FIG. 3 is a schematic view illustrating a configuration used for a simulation of influence of an electric field at a gap formed between the conveyance unit and the intermediate transfer body.

FIG. 3 is a schematic view illustrating a configuration used for a simulation of influence of the electric field at the gap. In FIG. 3, reference letter T denotes the toner of the black toner image transferred onto the sheet P. The sheet P attracted to the conveyance belt 8 is conveyed from right to left in FIG. 3. In this configuration, the secondary transfer roller 28 and the drive roller 17 are offset from each other. That is, as can be seen in FIG. 3, a virtual vertical dotted line C1 passing through the center of the secondary transfer roller 28 in FIG. 3 is, in this configuration, offset 1 mm upstream from a virtual vertical dotted line C2 passing through the center of the drive roller 17 in the direction of conveyance of the sheet P.

Figure 4:
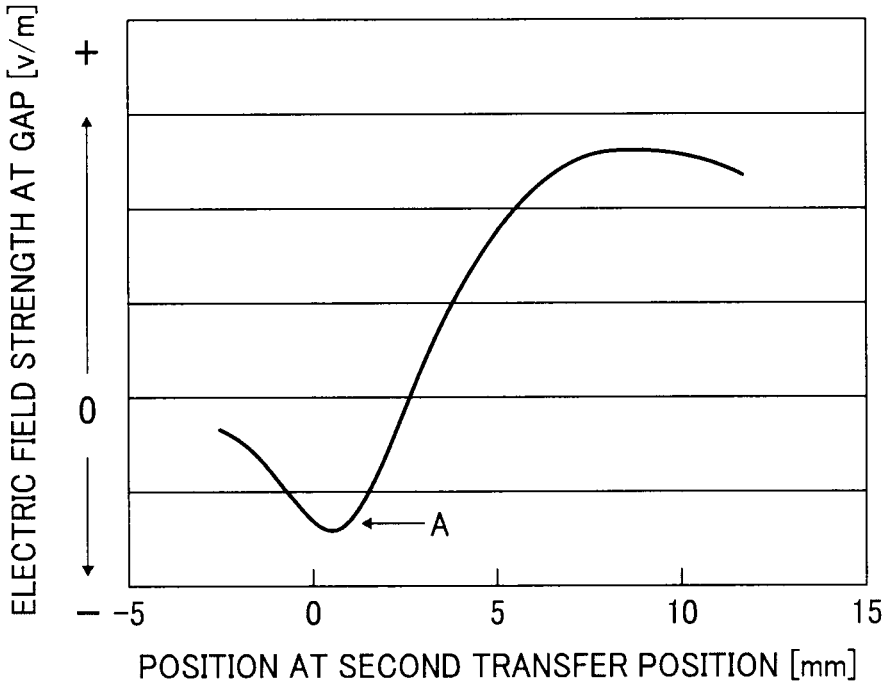
FIG. 4 is a graph showing results of calculations of electric field strength at the gap formed between the intermediate transfer body and the conveyance unit.

FIG. 4 is a graph showing results of calculations of electric field strength at the gap formed between the intermediate transfer belt 6 and the conveyance belt 8 in which the two rollers are offset from each other as described above. The results were calculated while the drive roller 17 and the secondary transfer roller 28 were grounded, under different dielectric constants and resistance values of the intermediate transfer belt 6 and the conveyance belt 8, respectively.

In FIG. 4, a negative direction indicates the direction of the electric field to scatter negatively charged toner of the black toner image toward the intermediate transfer belt 6. A value at point A in FIG. 4 was evaluated to determine whether or not the toner scatters at the gap. Whether or not the toner scatters is determined by the relatives strengths of the electric field, on the one hand, and a force that attracts the toner to the sheet P on the other.

Figure 5:
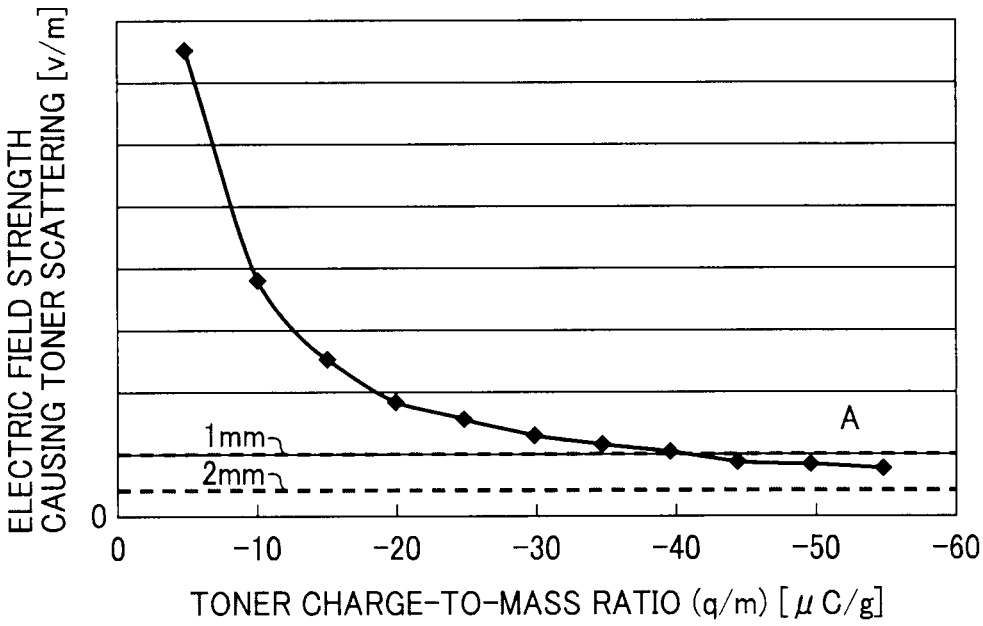
FIG. 5 is a graph showing relations between electric field strength causing tonner scattering, an amount of charge of toner, and minimum distance within the gap between the conveyance unit and the intermediate transfer body.

FIG. 5 is a graph showing relations between the electric field strength causing tonner scattering, an amount of charge of the toner, and a size of the gap at a portion where the intermediate transfer belt 6 and the conveyance belt 8 are positioned closest to each other, that is, a distance d in FIG. 3. As is clear from FIG. 5, the larger the amount of charge of toner, the easier it is to scatter the toner. However, the graph also shows that the toner does not scatter with the distance d of the gap of 2 mm or greater even when the amount of charge of the toner is about −50 μC/g.

Accordingly, the electric field at the gap between the intermediate transfer belt 6 and the conveyance belt 8 is set to prevent toner scattering at the gap upon conveyance of the sheet P through the gap, thereby preventing deterioration of the black toner image formed by the first image forming unit. It can be assumed that toner may scatter from the toner image formed on the sheet P depending on process conditions under an unstable electric potential at the gap upon conveyance of the sheet P through the gap. When the electric potentials of the drive roller 17 and the secondary transfer roller 28 are floating (i.e., are unstable), an electric potential of the charged toner image is affected by an electric potential of the components around the sheet P and becomes unstable. Therefore, the electric potentials of the drive roller 17 and the secondary transfer roller 28 are set not to float, to prevent the possibility of toner scattering at the gap.

The sheet P onto which the toner image formed by the first image forming unit is transferred is charged differently depending on conditions and environment during image formation by the first image forming unit, material of the sheet P, and so forth. The drive roller 17 and the secondary transfer roller 28 are grounded to prevent an excessive increase in the electric potential of the sheet P regardless of states of charge of the sheet P, thereby preventing toner scattering upon conveyance of the sheet P through the gap between the intermediate transfer belt 6 and the conveyance belt 8.

The drive roller 17 and the secondary transfer roller 28 are grounded as described above because no dedicated power supply is necessary, thereby simplifying the configuration. Alternatively, a voltage may be applied to the drive roller 17 and the secondary transfer roller 28, respectively. Application of voltage having the same polarity, that is, a negative polarity, to the drive roller 17, and application of voltage having the opposite polarity, that is, a positive polarity, to the secondary transfer roller 28, facilitate prevention of scattering of negatively charged toner from the toner image according to illustrative embodiments. Specifically, the voltage having the polarity opposite the polarity of the charged toner is applied to the secondary transfer roller 28 to further attract the toner of the toner image to the sheet P, thereby preventing toner scattering upon conveyance of the sheet P through the gap between the intermediate transfer belt 6 and the conveyance belt 8. In addition, the voltage having the same polarity as that of the charged toner is applied to the drive roller 17 to further attract the toner of the toner image to the sheet P, thereby preventing toner scattering upon conveyance of the sheet P through the gap between the intermediate transfer belt 6 and the conveyance belt 8.

As noted previously, if the electric potential of the drive roller 17 or the secondary transfer roller 28 is floating upon application of the voltages, an electric potential of the sheet P is considerably affected by the electric potentials of the components around the sheet P. Consequently, the electric potential of the toner image becomes unstable, possibly causing toner scattering.

It is to be noted that there is a configuration in which the intermediate transfer belt is separated from the photoconductors for the colors other than black to form a black toner image in the monochrome mode. However, in such a configuration, tension of the intermediate transfer belt varies due to changes in the position of the intermediate transfer belt, which is undesirable.

It is preferable that the intermediate transfer belt 6 be formed of an elastic material such as urethane rubber, silicone rubber, acrylonitrile rubber (NBR), or ethylene-propylene rubber (EPM or EPDM). Elasticity of the intermediate transfer belt 6 provides stable contact at the transfer positions, so that stable transfer of the toner images onto various types of recording media can be achieved.

Figure 6A:
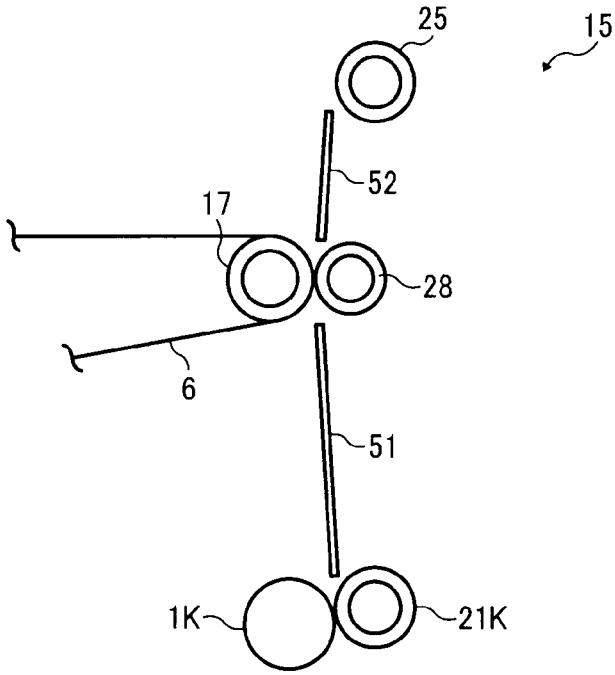
FIGS. 6A and 6B are schematic views respectively illustrating operations to contact or separate the conveyance unit to or from the intermediate transfer body according to a second illustrative embodiment.
Figure 6B:
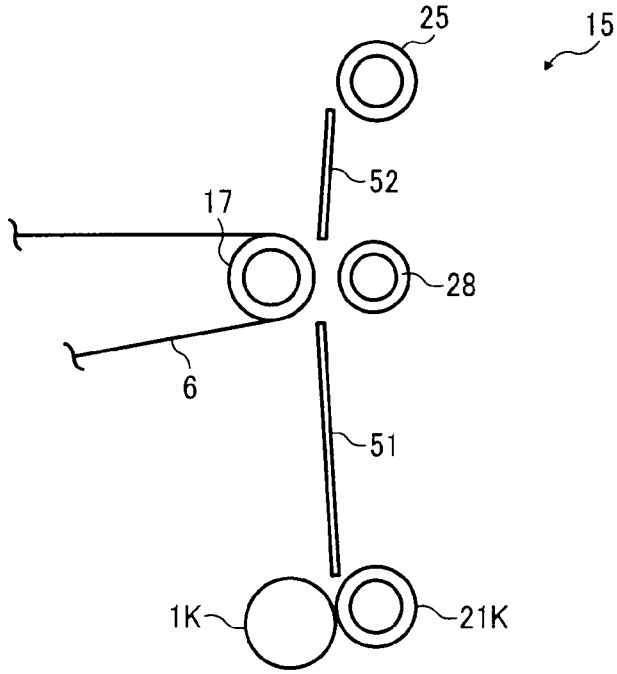

A descriptions is now given of a second illustrative embodiment of the present invention. FIGS. 6A and 6B are schematic views respectively illustrating operations to contact or separate the conveyance unit 15 to or from the intermediate transfer belt 6 according to the second illustrative embodiment. It is to be noted that, for brevity, only the differences from the first illustrative embodiment are described below.

In the second illustrative embodiment, the conveyance unit 15 includes the driven roller 21K, the drive roller 25, the secondary transfer roller 28, and guide plates 51 and 52. Specifically, the secondary transfer roller 28 is used in place of the conveyance belt 8 to serve as a conveyance roller, and the guide plates 51 and 52 that guide the sheet P are provided in the conveyance unit 15. In the full-color mode, the secondary transfer roller 28 contacts the intermediate transfer belt 6 as illustrated in FIG. 6A. In the monochrome mode, by contrast, the secondary transfer roller 28 is separated from the intermediate transfer belt 6 as illustrated in FIG. 6B.

As in the first illustrative embodiment, the secondary transfer roller 28 is grounded, or a voltage is applied to the secondary transfer roller 28 in order to prevent toner scattering at the gap between the intermediate transfer belt 6 and the secondary transfer roller 28. The guide plates 51 and 52 may be fixed to the main body of the image forming apparatus 100, or they may be provided to be moved together with the secondary transfer roller 28 by the contact/separation mechanism, not shown.

Elements and/or features of different illustrative embodiments may be combined with each other and/or substituted for each other within the scope of this disclosure and appended claims.

Illustrative embodiments being thus described, it will be apparent that the same may be varied in many ways. Such exemplary variations are not to be regarded as a departure from the scope of the present invention, and all such modifications as would be obvious to one skilled in the art are intended to be included within the scope of the following claims.

The number of constituent elements and their locations, shapes, and so forth are not limited to any of the structure for performing the methodology illustrated in the drawings.

What is claimed is:

1. An image forming apparatus comprising:

a conveyance unit to convey a transfer medium;

a first image forming unit to form a monochrome image transferred at a first transfer position onto the transfer medium conveyed on the conveyance unit; and a second image forming unit disposed downstream from the first image forming unit in a direction of conveyance of the transfer medium, comprising an intermediate transfer body to form a multi-colored toner image on the intermediate transfer body, with the multi-colored toner image transferred from the intermediate transfer body onto the transfer medium conveyed on the conveyance unit at a second transfer position different from the first transfer position;

the conveyance unit separating from the intermediate transfer body at the second transfer position in a monochrome mode to form the monochrome image on the transfer medium using only the first image forming unit, and contacting the intermediate transfer body at the second transfer position in a full-color mode to form a full-color image on the transfer medium using both the first and second image forming units; and the conveyance unit and the intermediate transfer body separated from each other at the second transfer position in the monochrome mode respectively having predetermined electric potentials at the second transfer position, wherein the intermediate transfer body includes:

multiple transfer support members comprising a first support member provided closest to the conveyance unit, the first support member having a predetermined electric potential; and an intermediate transfer belt wound around the multiple transfer support members, and wherein the conveyance unit comprises:

multiple conveyance support members comprising a second support member provided opposite the first support member at the second transfer position, a third support member provided on an extreme downstream side in the direction of conveyance of the transfer medium, and a fourth support member provided opposite the first image forming unit, a voltage having a polarity opposite a polarity of charged toner is applied to the second support member in the monochrome mode, a conveyance belt wound around the multiple conveyance support members, and the second support member has a predetermined electric potential, wherein the transfer medium is separated from the conveyance belt at the third support member in both the monochrome and full-color modes, wherein positions of the third and fourth support members remain unchanged in both the monochrome and full-color modes, wherein the multiple conveyance support members further comprise a tension roller to move along with movement of the second support roller to maintain the tension of the conveyance belt, and wherein the tension roller is interposed between the third support member and the fourth support member and contacts the conveyance belt at a position other than a conveyance path of the transfer medium.

2. The image forming apparatus according to claim 1, wherein the first support member is grounded in the monochrome mode.

3. The image forming apparatus according to claim 1, wherein a voltage having the same polarity as that of charged toner is applied to the first support member in the monochrome mode.

4. The image forming apparatus according to claim 1, wherein the second support member contacts the conveyance belt in the monochrome mode.

5. The image forming apparatus according to claim 1, wherein the second support member is moved to cause the conveyance belt to contact the intermediate transfer belt at the second transfer position in the full-color mode.

6. The image forming apparatus according to claim 1, wherein a closest distance between the conveyance unit and the intermediate transfer body separated from each other at the second transfer position in the monochrome mode is not less than 2 mm.

7. The image forming apparatus according to claim 1, wherein the intermediate transfer body comprises an elastic body.

8. An image forming apparatus comprising:

a conveyance unit to convey a transfer medium;

a first image forming unit to form a monochrome image transferred at a first transfer position onto the transfer medium conveyed on the conveyance unit; and a second image forming unit disposed downstream from the first image forming unit in a direction of conveyance of the transfer medium, comprising an intermediate transfer body to form a multi-colored toner image on the intermediate transfer body, with the multi-colored toner image transferred from the intermediate transfer body onto the transfer medium conveyed on the conveyance unit at a second transfer position different from the first transfer position;

the conveyance unit separating from the intermediate transfer body at the second transfer position in a monochrome mode to form the monochrome image on the transfer medium using only the first image forming unit, and contacting the intermediate transfer body at the second transfer position in a full-color mode to form a full-color image on the transfer medium using both the first and second image forming units; and an electric field generated at the second transfer position in the monochrome mode having a strength insufficient to scatter toner of the monochrome image formed by the first image forming unit upon conveyance of the monochrome image through the second transfer position, wherein the intermediate transfer body includes:

multiple transfer support members comprising a first support member provided closest to the conveyance unit; and an intermediate transfer belt wound around the multiple transfer support members, and wherein the conveyance unit comprises:

multiple conveyance support members comprising a second support member provided opposite the first support member at the second transfer position, the first support member having a predetermined electric potential, a third support member provided on an extreme downstream side in the direction of conveyance of the transfer medium, and a fourth support member provided opposite the first image forming unit, and a voltage having a polarity opposite a polarity of charged toner is applied to the second support member in the monochrome mode, a conveyance belt wound around the multiple conveyance support members, and the second support member has a predetermined electric potential, wherein the transfer medium is separated from the conveyance belt at the third support member in both the monochrome and full-color modes, wherein positions of the third and fourth support members remain unchanged in both the monochrome and full-color modes, wherein the multiple conveyance support members further comprise a tension roller to move along with movement of the second support roller to maintain the tension of the conveyance belt, and wherein the tension roller is interposed between the third support member and the fourth support member and contacts the conveyance belt at a position other than a conveyance path of the transfer medium.

* * * * *